US010217574B2

(12) United States Patent
Zimmermann

(10) Patent No.: US 10,217,574 B2
(45) Date of Patent: Feb. 26, 2019

(54) LOW-VOLTAGE SWITCHING DEVICE WITH A VARIABLE DESIGN

(71) Applicant: Siemens Aktiengesellschaft, Munich (DE)

(72) Inventor: Norbert Zimmermann, Sulzbach-Rosenberg (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 14/914,340

(22) PCT Filed: Sep. 13, 2013

(86) PCT No.: PCT/EP2013/068980
§ 371 (c)(1),
(2) Date: Feb. 25, 2016

(87) PCT Pub. No.: WO2015/036028
PCT Pub. Date: Mar. 19, 2015

(65) Prior Publication Data

US 2016/0211092 A1 Jul. 21, 2016

(51) Int. Cl.

| | |
|---|---|
| ***H01H 9/02*** | (2006.01) |
| ***H01H 50/14*** | (2006.01) |
| ***H01H 50/44*** | (2006.01) |
| ***H01H 9/00*** | (2006.01) |
| ***H01H 9/34*** | (2006.01) |
| *H01H 50/02* | (2006.01) |

(Continued)

(52) U.S. Cl.
CPC ..... *H01H 9/02* (2013.01); *H01H 9/0066* (2013.01); *H01H 9/34* (2013.01); *H01H 50/14* (2013.01); *H01H 50/443* (2013.01); *H01H 50/021* (2013.01); *H01H 50/545* (2013.01); *H01H 2011/0037* (2013.01)

(58) Field of Classification Search
CPC . H01H 71/0228; H01H 50/541; H01H 50/546
USPC ..... 335/131–132
See application file for complete search history.

(56) References Cited

U.S. PATENT DOCUMENTS 4,345,225 A * 8/1982 Lemmer ..... H01H 50/02 335/132
4,899,120 A * 2/1990 Ohtake ..... H01H 9/0264 335/132

(Continued)

FOREIGN PATENT DOCUMENTS

CN 1262774 8/2000
CN 101512706 8/2009

(Continued)

OTHER PUBLICATIONS

Office Action dated Dec. 23, 2016 which issued in the corresponding Chinese Patent Application No. 201380077855.8.

*Primary Examiner* — Alexander Talpalatski
(74) *Attorney, Agent, or Firm* — Cozen O'Connor

(57) ABSTRACT

A low-voltage switching device includes a base module, with a connection region for electrical conductors. Auxiliary contacts and a coil connection are arranged in a separate auxiliary module that is attachable to and detachable from the base module to maximize flexibility in configuration, manufacture, functionality and utility of the switching device while reducing production costs.

7 Claims, 4 Drawing Sheets

(51) Int. Cl.
*H01H 11/00* (2006.01)
*H01H 50/54* (2006.01)

(56) References Cited

U.S. PATENT DOCUMENTS

| | | | | |
|---|---|---|---|---|
| 4,992,765 | A * | 2/1991 | Hirota | H01H 50/021 335/131 |
| 5,117,210 | A * | 5/1992 | Castonguay | H01H 71/0228 335/167 |
| 5,347,250 | A * | 9/1994 | Muske | H01H 49/00 335/132 |
| 6,285,271 | B1 | 9/2001 | Bauer et al. | |
| 7,474,182 | B2 * | 1/2009 | Bolz | H01H 50/045 335/131 |
| 7,679,477 | B2 * | 3/2010 | Portier | H01H 50/443 220/3.2 |
| 7,821,364 | B2 * | 10/2010 | Birzer | H01H 50/14 335/132 |
| 7,843,291 | B2 * | 11/2010 | Titus | H01H 71/04 335/132 |
| 7,973,625 | B2 * | 7/2011 | Chandrappa | H01H 50/541 200/243 |
| 8,305,170 | B2 * | 11/2012 | Koppmann | H01H 71/08 335/106 |
| 8,581,680 | B2 | 11/2013 | Portier | |
| 2002/0112946 | A1 * | 8/2002 | Greenberg | H01H 71/465 200/50.32 |
| 2007/0194869 | A1 * | 8/2007 | Titus | H01H 71/04 335/172 |
| 2008/0100405 | A1 | 5/2008 | Portier | |
| 2008/0150660 | A1 | 6/2008 | Birzer et al. | |
| 2009/0325423 | A1 | 12/2009 | Bollinger et al. | |
| 2011/0205003 | A1 * | 8/2011 | Koppmann | H01H 71/08 335/8 |
| 2012/0133460 | A1 * | 5/2012 | Okubo | H01H 50/323 335/132 |
| 2012/0178304 | A1 | 7/2012 | Portier | |

FOREIGN PATENT DOCUMENTS

| | | |
|---|---|---|
| CN | 101796606 | 8/2010 |
| CN | 102365699 | 2/2012 |
| DE | 19729595 | 10/1998 |
| DE | 102005040348 | 3/2007 |
| WO | WO 2009/018864 | 2/2009 |

* cited by examiner

LOW-VOLTAGE SWITCHING DEVICE WITH A VARIABLE DESIGN

CROSS-REFERENCE TO RELATED APPLICATION

This is a U.S. national stage of application No. PCT/EP2013/068980 filed 13 Sep. 2013.

FIELD OF THE INVENTION

The present invention relates to a low-voltage switching devices with a base module that includes a connection region for electric conductors.

BACKGROUND OF THE INVENTION

For low-voltage switching devices, specifically contactors, a variety of switching device designs are available for different industrial applications. For example, for the switching of motors, three-pole or four-pole switching devices are required, while the switching of capacitor banks requires special capacitor switching contactors for reactive power compensation and special contactor designs which permit communication with a programmable logic controller (PLC). All of these switching device designs are also associated with requirements for different connection options, including screw connectors, spring-loaded terminals or ring cable shoe connectors.

To date, these switching device designs have been realized using specific devices produced for this purpose. Basic elements for these devices, such as arcing chambers or contact carriers, notwithstanding the relatively small production runs involved in some cases, nevertheless require complex and complete tooling for their production. This results in increased production costs for these devices which, as a result of the highly complex tools involved in the routine production process, are also susceptible to failures and dimensional deviations.

OBJECTS AND SUMMARY OF THE INVENTION

It is accordingly an object of the present invention to provide a low-voltage switching device which can be adapted to different device designs in the simplest possible manner.

In accordance with the invention, this object is fulfilled by a low-voltage switching device that includes a base module, which has a connection region for electrical conductors. Auxiliary contacts and a coil connection are arranged in a separate auxiliary module that is separable from the base module.

By utilizing this variable, modular design of the inventive low-voltage switching devices, it is possible to produce, by exchanging individual device components, any of a wide variety of switching device designs that may be required for a particular application. Accordingly, for example, by exchanging one device component, in the present case by exchanging the auxiliary module, it is possible to incorporate provision for a variety of connection systems. The auxiliary module according to the invention can be manufactured using easily-produced tools. In the auxiliary module, individual device components continue to be used universally, without changes. By the corresponding configuration of the auxiliary module, further device designs can be produced including, for example, capacitor contactors or contactors for communication applications. As a result of its characteristic unit design, the auxiliary module according to the invention is also suitable for application in different sizes.

The core feature of the invention is a variable device design, resulting from use of a base module and a separate or separable auxiliary module. By the corresponding configuration of the auxiliary module, by means of exchanging or the assembly of the device in a given manufacturing process, switching devices of different designs can easily be produced. This is advantageously associated with a reduction in the variety of components, as a result of the modular application of individual components or individual sub-assemblies. This leads to a cost reduction in the design of devices, associated with automation, specifically in the manufacture of small switching device production runs. There is a further advantage, in that a simpler, and consequently more cost-effective production of tools is possible. A further advantage is associated with the separation of the main control level from the auxiliary control level, whereby the main control level is arranged in the base module and the auxiliary control level is arranged in the auxiliary module. Accordingly, basic devices can also be converted subsequent in time. It is consequently also possible to employ abrasion-optimized material combinations for the main and auxiliary control circuits. As the auxiliary modules according to the invention, on the grounds of their characteristic unit design, can encompass different sizes, an advantageous reduction in the variety of components or sub-assemblies is possible. Moreover, this provides an advantage in that assembly of the requisite switching devices can be completed rapidly and in situ.

In a particularly advantageous exemplary embodiment of the invention, the auxiliary module may be configured as a standard auxiliary module, as a communication auxiliary module or as a capacitor switching contactor auxiliary module. This device variation is made possible by the variable design of the inventive switching devices. The various auxiliary modules can be configured by exchanging individual device components. Exchangeable device components include the connection system, the surge limiter and the housing cover.

In a further exemplary embodiment of the invention, the auxiliary module may be configured with a screw connector terminal system, a spring-loaded terminal system or a ring cable shoe connector system. By means of these three different connection systems, it is possible to achieve a wide variety of devices.

In accordance with another advantageous embodiment, the auxiliary module may comprise an exchangeable surge limiter that is appropriate for the particular intended application of the auxiliary module. The surge limiter, together with the connection system and the housing cover, is included in those device components which can be fitted to the auxiliary module in a variable arrangement.

In a further implementation, the auxiliary module may comprise an exchangeable enclosure appropriate for the intended application of the auxiliary module. Together with the connection system and the surge limiter, this enclosure is the third component which can be exchanged. Accordingly, it is possible to achieve a wide variety of devices.

In another contemplated embodiment of the invention, the auxiliary module may comprise moveable switching contacts with a contact carrier and a base plate, which are universally configured identically in all auxiliary module devices. These device components can be manufactured in correspondingly high numbers, as they are suitable for universal application in all auxiliary modules.

A further particularly advantageous exemplary embodiment of the invention provides that the auxiliary module is configured with various arcing chambers and associated fixed contact pieces and coil connections in different types of connection systems, with or without cable ducts.

In a further particularly advantageous embodiment of the invention, the arcing chamber of the auxiliary module may be configured such that the arcing chamber can be fitted with up to four auxiliary or main conducting paths.

In accordance with preferred implementations of the invention, the low-voltage switching device may be a contactor.

The low-voltage switching device of the invention, as implemented specifically as a contactor, is constructed in two parts, one of which is a base module that is preferably of cuboid design with an upper side, an underside and four lateral elements. A connection region for electrical conductors is preferably arranged on one or two of the lateral elements. Another, separate, auxiliary module, which is attachable to and detachable from the base module, is preferably arranged on the upper side. The auxiliary module is also preferably configured as a cuboid, with an upper side, an underside and four lateral elements. The auxiliary module of the invention comprises a base plate and a contact carrier with moveable switching contacts. These device components are configured identically in all auxiliary module devices. The auxiliary module is also provided with an enclosure of variable configuration, a surge limiter of variable design and an arcing chamber of variable configuration with fixed contact pieces and coil connections with a variable connection system.

The present invention is characterized by variable device design, resulting from the use of a base module and an auxiliary module. By the corresponding configuration of the auxiliary module, through exchange or assembly of the device in a given manufacturing process, switching devices of different designs can easily be produced. This is advantageously associated with a reduction in the variety of components, as a result of the modular application of individual components or individual sub-assemblies. This leads to a cost reduction in the design of devices, associated with automation, specifically in the manufacture of small switching device production runs. As a further advantage, the simpler and consequently more cost-effective production of tools is possible.

Further advantages and embodiments of the invention are described hereinafter with reference to one exemplary embodiment and with reference to the drawings.

DETAILED DESCRIPTION OF THE PREFERRED EMBODIMENTS

Figure 1:
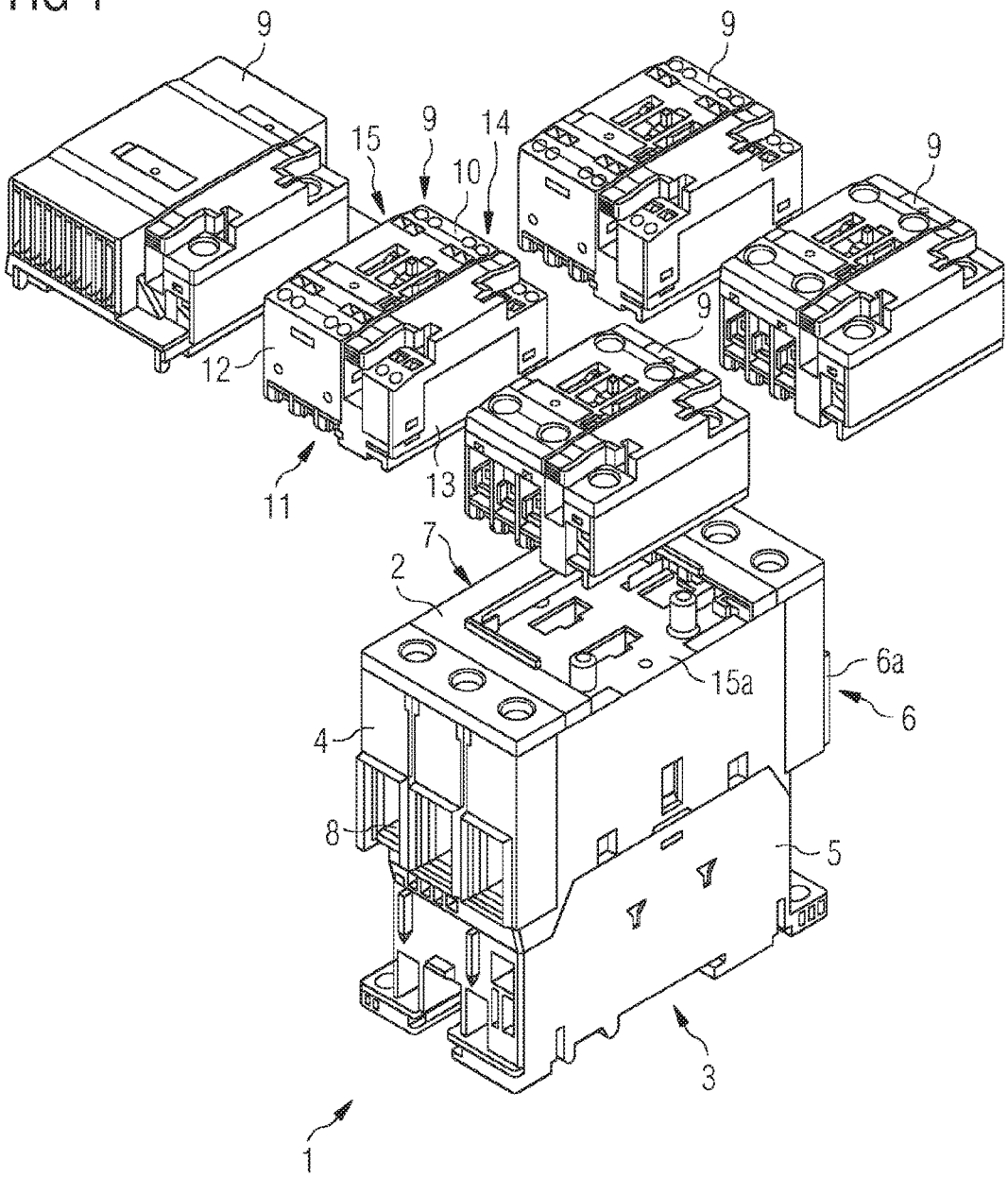
FIG. 1 is an elevated perspective view of a low-voltage switching device according to the invention, with a base module and a plurality of separate auxiliary modules which are variably adapted to the type of application.
Figure 2:
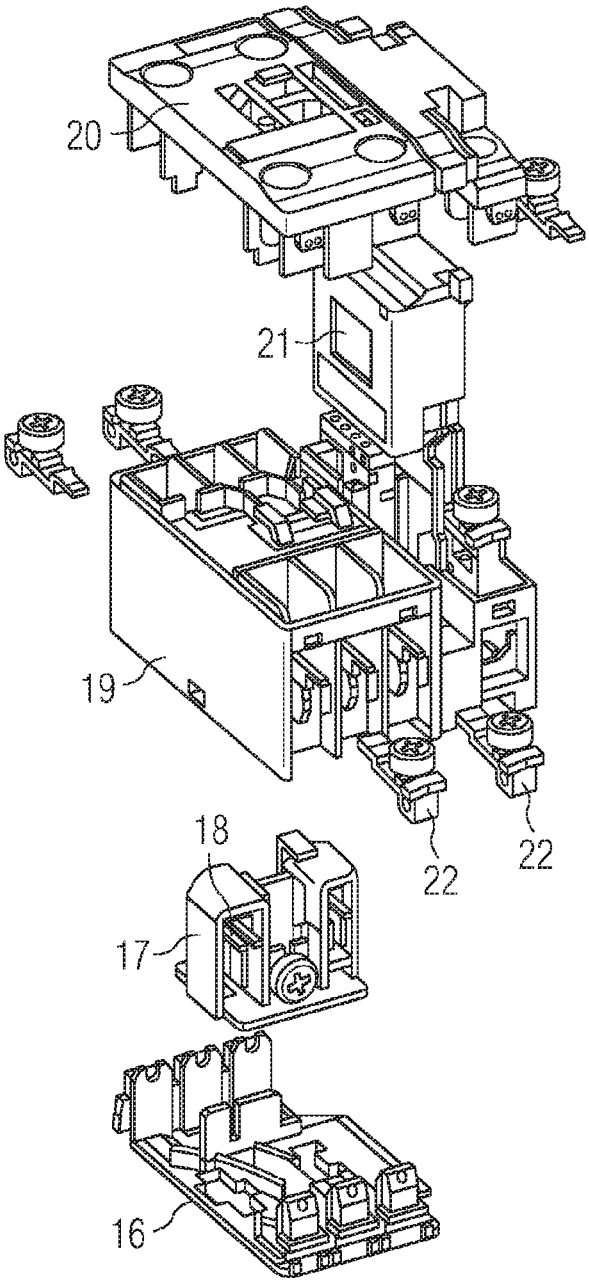
FIG. 2 is an exploded, elevated perspective view of a standard auxiliary module according to the invention.

FIG. 1 depicts a low-voltage switching device, in particular a contactor, constructed in accordance with the invention. The low-voltage switching device is configured in two parts, including a base module 1 that is preferably of cuboid design and includes an upper side 2, an underside 3 and four lateral elements 4, 5, 6, 7. A connection region 6*a* and 8 for electrical conductors is preferably arranged on the lateral elements 4 and 6. A separate auxiliary module 9, which is attachable to and detachable from the base module 1, is preferably arranged on the upper side 2 of based module 1. Auxiliary module 9—several distinct forms of which are depicted in FIG. 2—may be configured as a standard auxiliary module, as a communication auxiliary module, or as a capacitor switching contactor auxiliary module. The auxiliary module 9 is preferably also of cuboid design, with an upper side 10, an underside 11 and four lateral elements 12, 13, 14, 15. The auxiliary module 9 is mountable on the base module 1, preferably in a recess 15*a* in base module 1.

FIG. 2 depicts a standard auxiliary module constructed in accordance with the invention. The auxiliary module 9 of the invention comprises a base plate 16 and a contact carrier 17 with moveable switching contacts 18. These device components are configured identically in all auxiliary module devices. Auxiliary module 9 of the invention is also provided with an enclosure 20 of variable configuration, a surge limiter 21 of variable design and an arcing chamber of variable configuration with a connection region 22, which region 22 is appropriate for both auxiliary circuits and control circuits.

Figure 3:
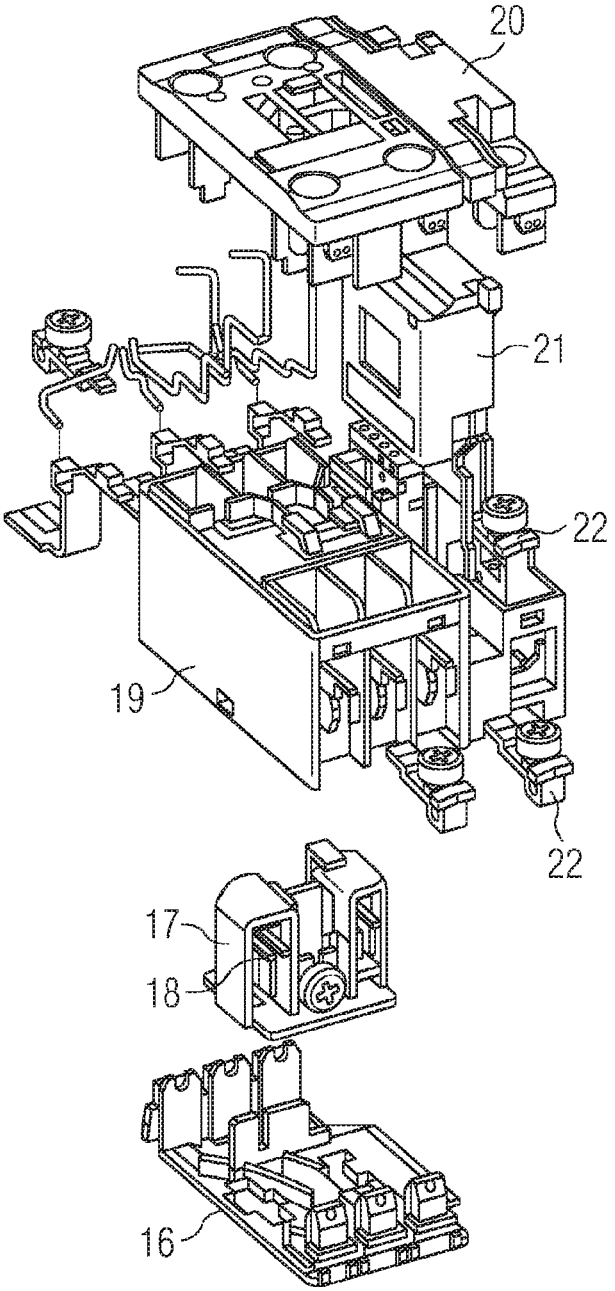
FIG. 3 is an exploded, elevated perspective view of a communication auxiliary module according to the invention.
Figure 4:
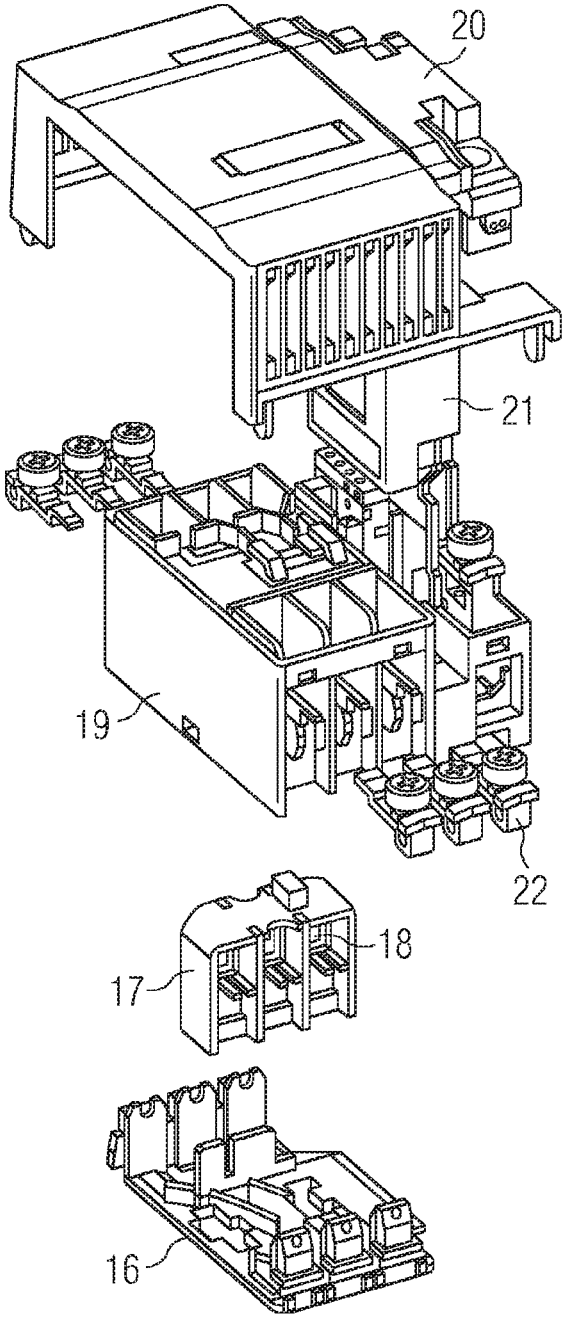
FIG. 4 is an exploded, elevated perspective view of a capacitor switching contactor auxiliary module according to the invention.

FIG. 3 shows the auxiliary module 9 of the invention in the form of a communication auxiliary module. In FIG. 4, the depicted auxiliary module 9 is a capacitor switching contactor auxiliary module.

The present invention is characterized by a variable device design, resulting from the use of a base module and an auxiliary module. By the corresponding configuration of the auxiliary module, and the exchange or assembly of the device in a given manufacturing process, switching devices of a wide variety of different designs can easily be produced. Moreover, the auxiliary module is configured for attachment to different sizes of switching devices. This is advantageously associated with a reduction in the variety of components, as a result of the modular use of individual components or individual sub-assemblies. This leads to a cost reduction in the design of devices, associated with automation, specifically in the manufacture of small switching device production runs. A further advantage is that the simpler, and consequently more cost-effective, production of tools is possible.

The invention claimed is:

1. A low-voltage switching device, comprising:

a base module having at least one connection region for electric conductors;

a separate auxiliary module having auxiliary contacts and a coil connection arranged in a separable manner from the base module, the separate auxiliary module being configured to attach to differently sized switching devices;

wherein the separate auxiliary module includes a variable configuration exchangeable surge limiter, selected for an intended application of the separate auxiliary module and arranged within the separate auxiliary module, includes an arc chamber having a variable configuration and includes an exchangeable enclosure having a variable configuration and moveable switching contacts with a contact carrier and a base plate, which are universally configured identically in each of a plurality of separate auxiliary modules; and wherein the separate auxiliary module is selected from a group consisting of a first auxiliary module having a first configuration, a second auxiliary module having a second configuration and a third auxiliary module having a third configuration, the first, second and third configurations being different from each other.

2. The low-voltage switching device of claim 1, wherein the auxiliary module is configured as one of a standard auxiliary module, a communication auxiliary module and a capacitor switching contactor auxiliary module.

3. The low-voltage switching device of claim 1, wherein the auxiliary module further comprises one of a screw connector terminal system, a spring-loaded terminal system and a ring cable shoe connector system.

4. The low-voltage switching device of claim 1, wherein the exchangeable enclosure is selected for an intended application of the auxiliary module.

5. The low-voltage switching device of claim 1, wherein the auxiliary module is configured with various arcing chambers and associated fixed contact pieces and coil connections in different types of connection systems, with or without cable ducts.

6. The low-voltage switching device of claim 5, wherein the arcing chamber of the auxiliary module is configured such that said arcing chamber can accommodate up to four auxiliary or main conducting paths.

7. The low-voltage switching device of claim 1, wherein the low-voltage switching device is a contactor.

* * * * *